US006994416B2

(12) United States Patent
Seki et al.

(10) Patent No.: US 6,994,416 B2
(45) Date of Patent: Feb. 7, 2006

(54) INKJET RECORDING APPARATUS FOR CONTROLLING RECOVERY OPERATION BY MANAGING CAP-OPEN STATE AND RECOVERY CONTROL METHOD

(75) Inventors: Satoshi Seki, Tokyo (JP); Naoji Otsuka, Kanagawa (JP); Osamu Iwasaki, Tokyo (JP); Minoru Teshigawara, Kanagawa (JP); Yoshinori Nakagawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 10/647,272

(22) Filed: Aug. 26, 2003

(65) Prior Publication Data

US 2004/0041874 A1 Mar. 4, 2004

(30) Foreign Application Priority Data

Aug. 30, 2002 (JP) ..... 2002-253893

(51) Int. Cl.
*B41J 29/393* (2006.01)
*B41J 2/165* (2006.01)

(52) U.S. Cl. ..... 347/19; 347/29

(58) Field of Classification Search ..... 347/19, 347/22–23, 29–30, 32; B41J 2/165
See application file for complete search history.

(56) References Cited

U.S. PATENT DOCUMENTS 4,970,534 A * 11/1990 Terasawa et al. ..... 347/32
5,086,305 A 2/1992 Terasawa ..... 347/30
5,459,496 A * 10/1995 Hanabusa et al. ..... 347/5
6,019,451 A 2/2000 Kawaguchi et al. ..... 347/29
6,234,604 B1 * 5/2001 Kawakami et al. ..... 347/23

FOREIGN PATENT DOCUMENTS

EP 1031425 A2 * 8/2000
JP 63-252748 10/1988

OTHER PUBLICATIONS

U.S. Appl. No. 09/956,790, Otsuka et al., filed Sep. 21, 2001.

U.S. Appl. No. 10/636,687, Iwasaki et al., filed Aug. 8, 2003.

* cited by examiner

*Primary Examiner*—Thinh Nguyen
(74) *Attorney, Agent, or Firm*—Fitzpatrick, Cella, Harper & Scinto

(57) ABSTRACT

An inkjet recording apparatus suppresses defective ejection while reducing a consumed ink amount. In the apparatus, a cap-open period, during which a cap member does not cap ejection ports of a recording head of the apparatus, is measured, and a recovery operation executed by a recovery unit is controlled based on a cumulated cap-open period. With the above arrangement, there can be solved a problem that the ink ejecting state of the recording head is deteriorated depending on a recording operation because a cap-open state, in which the cap member does not cap the ejection ports of the recording head, continues while the inkjet recording apparatus executes the recording operation, thereby the reliability of the inkjet recording apparatus can be improved.

10 Claims, 8 Drawing Sheets

INKJET RECORDING APPARATUS FOR CONTROLLING RECOVERY OPERATION BY MANAGING CAP-OPEN STATE AND RECOVERY CONTROL METHOD

BACKGROUND OF THE INVENTION

1. Field of the Invention

The present invention relates to an inkjet recording apparatus for executing recording using a recording head for ejecting inks and to a recovery control method of recovering the ejecting state of the recording head.

2. Related Background Art

Recording apparatuses such as a printer, copy machine, facsimile, and the like are arranged to record an image composed of a dot pattern on a recording member such as a paper sheet, plastic thin sheet, and the like. Recording systems employed by the recording apparatuses can be classified into an inkjet system, wire dot system, thermal system, laser beam system, and the like.

Among them, the inkjet system ejects flying ink droplets as a recording liquid from ejection ports acting as openings located at the extreme ends of the nozzles of a recording head (inkjet recording head) and executes recording by depositing the ink droplets on a recording member.

In the recording apparatuses employing the inkjet system, it is conventionally known that the ejection ports of the recording head become clogged because the inks ejected from the ejection ports are evaporated, and thus a recorded state is deteriorated or it becomes difficult to execute recording in some cases. To suppress the evaporation of the inks, there is generally provided a mechanism for capping the ejection ports of the recording head using a capping member when the recording apparatus is not in operation. In the above arrangement, it is known to switch the recording apparatus between a closed state and an open state according to whether the recording apparatus is in a recording state or in a waiting state by a mechanism for relatively moving the capping member and the recording head so that the ejection ports are shut off from the outside air by capping the ejection ports with the capping member by causing the capping member to come into intimate contact with the surface on which the ejection ports of the recording head are formed (referred to as the "cap closed state" or the "closed state") and that the capping member is separated from the surface on which the ejection ports are formed (referred to as the "cap open state" or the "open state").

While the evaporation of inks is suppressed by the above mechanism of the cap, bubbles are gradually generated in the ink nozzles as a period elapses, whereby printing defects may be caused by the bubbles. Further, the viscosity of the inks in the ink nozzles increases as the period elapses, whereby the printing defects may be caused. The phenomenon that the bubbles are generated in the nozzles as the period elapses is caused by the fact that a gas dissolved in the inks as a liquid appears as the bubbles. Further, deterioration of a printed state due to the printing defect is caused by the fact that inks are unstably ejected or are not ejected owing to the increase of the viscosity of the inks existing in the ejection ports of the nozzles and the fact that the color materials of the inks and the impurities in the inks precipitate around the ejection ports as a solvent in the inks evaporates. To cope with the deterioration of the printed state described above, many inkjet recording apparatuses employ a method of executing a print operation by recovering the recording head by forcibly sucking the inks from the outside.

In the recovery operation executed by sucking the inks, a large amount of the inks is discharged by executing the operation once. Thus, it is preferable to execute the recovery operation as less frequently as possible to reduce a consumed ink amount. This is because a running cost can be particularly suppressed as well as the capacity of a waste inks accommodation unit for accommodating discharged inks can be reduced by suppressing the amount of the inks discharged by the recovery operation. For this purpose, it is known in conventional recording apparatuses to provide a timer or an arrangement for measuring a period similar to the timer with the recording apparatus, to measure a period elapsed from a last-executed suction operation, and to determine whether or not inks are to be sucked according to the elapsed period.

As an example, when the suction operation is not executed even if, for example, two or five days have elapsed, a suction recovery operation (referred to as "timer suction") is executed in an amount of suction set according to an elapsed period. Further, when the elapsed period is shorter than two days, a timer preliminary ejection operation, which is a recovery operation executed by ejecting inks, is executed according to the elapsed period. With the above operations, the increase in viscosity of the inks in the nozzles and the precipitation of the color material and the impurities of the inks around the nozzles can be prevented.

In the arrangement of the conventional recording apparatuses, since the period elapsed from the last-executed suction operation is measured based on the timing at which the suction operation is executed, there is not considered a case in which a degree of evaporation of inks differs depending on a state of the recording apparatus. Thus, there is case in which the ejecting state of the recording head cannot be favorably recovered. Further, when preference is given to the recovery of the ejecting state of the recording head, it is contemplated to previously set to execute a suction recovery operation even if an elapsed period is relatively short, assuming that the ink has evaporated in a considerable amount. In this case, however, there is a possibility that the suction recovery operation is executed even if the operation is not necessary judging from the degree of evaporation of the inks.

Further, since it is preferable to suck the inks as less frequently as possible to suppress the consumed ink amount, the suction recovery operation is executed only when the elapsed period has reached a certain degree of a long period. In this case, however, the recording head may not be sufficiently recovered depending on a state of the recording apparatus.

For example, when only black characters are continuously printed (for example, two or three hours) and then a color image is recorded, the nozzles for ejecting color inks are continuously kept in the cap open state without executing recording. In this case, the color materials and the impurities of the color inks precipitate around the color ink nozzles and may be crystallized depending on evaporating conditions. Accordingly, printing defects may be caused by these precipitants and the crystallization of the color materials and impurities.

Likewise, a special sheet such as a glossy medium is generally controlled such that it is not printed with a black pigment. When, however, an image is recorded on the special sheet by color printing (for example, continuously for two to three hours) and then characters are printed using the black pigment, the nozzles for ejecting the ink containing the black pigment are continuously kept in the cap open state without executing recording. As a result, the nozzles are clogged by the adhesion of the inks whose viscosity is increased because the inks are dried, thereby printing defects occur.

Accordingly, in an arrangement in which the timer preliminary ejection described above is executed when a period, during which the suction is not executed, is short, the recovery operation cannot be executed sufficiently in the case of the example described above, thereby the printing defect is caused.

As described above, the cap of the nozzles for ejecting a certain ink may be continuously kept in the open state depending on a recording operation. Inks are evaporated and dried and precipitants are produced in an elapsed period in different degrees, depending on whether the cap is opened or closed. Accordingly, the conventional arrangement for determining the execution of the suction recovery operation based on the elapsed period has a problem in that inks are wastefully consumed in the suction recovery operation and that defective ejection occurs more frequently.

SUMMARY OF THE INVENTION

An object of the present invention, which was made in view of the above problems, is to provide an inkjet recording apparatus having high reliability capable of reducing a consumed ink amount, suppressing occurrence of defective ejection and decreasing a running cost by properly controlling execution of a recovery operation as well as to provide a recovery control method.

To achieve the above object, the present invention relates to an inkjet recording apparatus for executing recording by ejecting inks onto a recording medium based on recorded data using a recording head for ejecting inks from ejection ports, the inkjet recording apparatus, comprising recovery means for executing recovery processing for maintaining the ink ejection capability of the recording head; a cap member for capping the ejection ports of the recording head, capping means for moving the cap member in a direction where the cap member approaches the recording head and in a direction where the cap member is separated from the recording head, measurement means for measuring a cap-open period that is an elapsed period of a cap-open state in which the ejection ports are not capped with the cap member, and control means for executing the recovery processing by the recovery means when the cap-open period cumulated by cumulation means exceeds a predetermined period.

Further, in a recovery control method of the present invention in an inkjet recording apparatus which executes recording by ejecting inks onto a recording medium based on recorded data using a recording head for ejecting the inks from ejection ports, and comprises recovery means for executing recovery processing for maintaining the ink ejection capability of the recording head, a cap member for capping the ejection port of the recording head, and capping means for moving the cap member in a direction where the cap member approaches the recording head and in a direction where the cap member is separated from the recording head, the recovery control method comprises the steps of measuring a cap-open period that is an elapsed period of a cap-open state in which the ejection ports are not capped by the cap member, and executing the recovery processing by the recovery means when the cap-open period cumulated by cumulation means exceeds a predetermined period.

DESCRIPTION OF THE PREFERRED EMBODIMENTS

Embodiments of the present invention will be described below with reference to the figures.

Figure 1:
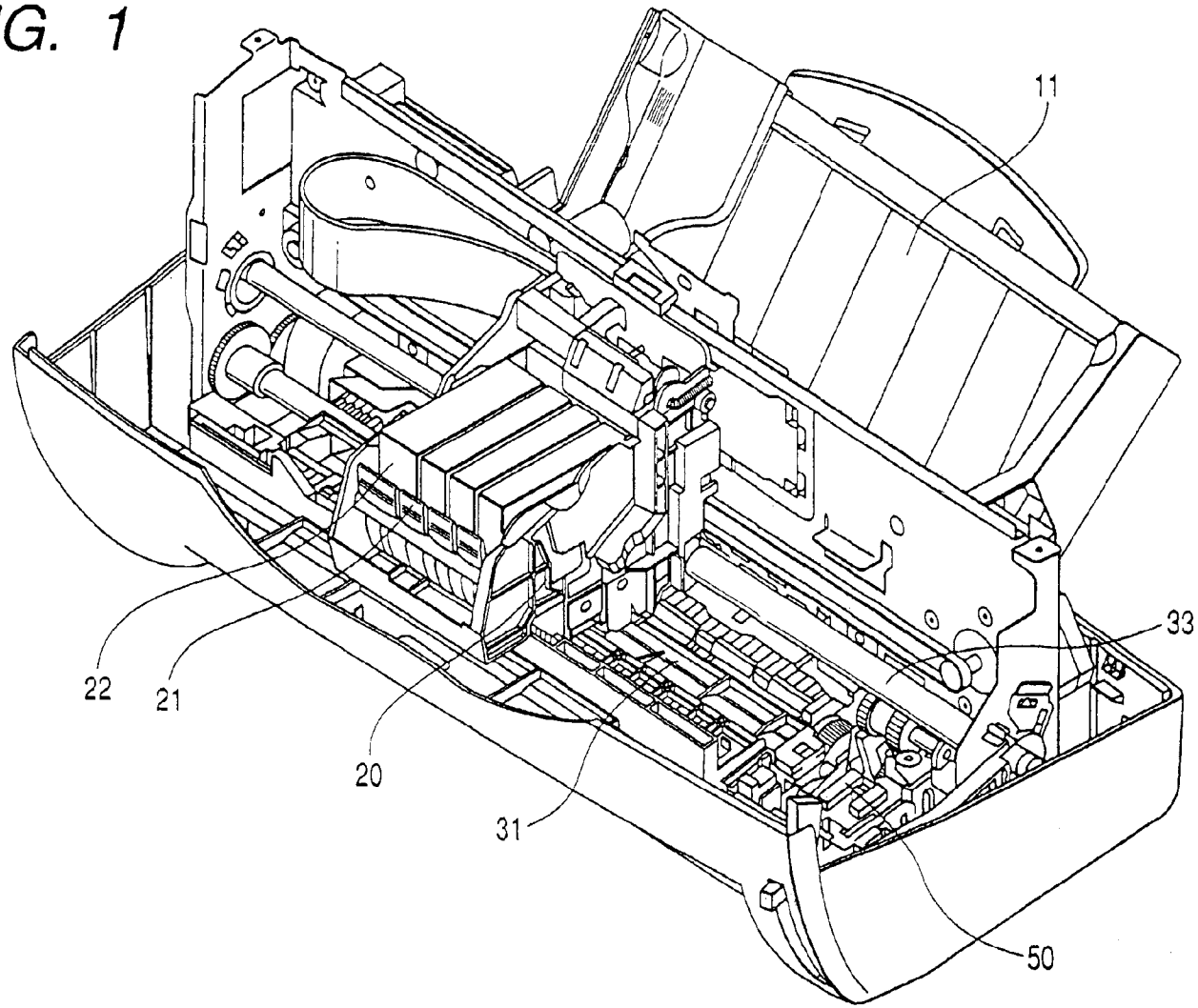
FIG. 1 is a schematic perspective view showing the overall arrangement of an inkjet recording apparatus to which the present invention can be applied.

FIG. 1 is a schematic perspective view showing the overall arrangement of an inkjet recording apparatus to which the present invention can be applied. In FIG. 1, the inkjet recording apparatus, from which an upper case acting as an exterior cover is removed, is shown.

In FIG. 1, a sheet (recording medium) set in a sheet conveying tray 11 is fed by the rotation of a sheet feeding roller (not shown), and the thus fed sheet is conveyed on a platen 31 by a conveying roller (not shown). An image and the like are recorded (formed) on the sheet by ejecting inks from a recording head 21 mounted on a carriage 20 while conveying the sheet in a predetermined amount and executing scanning by the carriage 20 repeatedly.

In FIG. 1, the recording head 21 and ink tanks 22, in which the inks to be supplied to the recording head 21 are stored, are detachably mounted on the carriage 20. The carriage 20 is slidably engaged with a scanning rail 33 as well as supplied with drive force from a carriage motor 73 (refer to FIG. 5) through a transmission mechanism such as a belt or the like so as to enable the recording head 21 to execute scanning. Further, a recovery system 50 is disposed at an end of the moving range of the carriage 20 to execute ejection recovery processing to maintain the ejecting function of the recording head 21 in a good state.

Note that the recording head 21 and the ink tanks 22 are detachably mounted on the carriage 20 as described above. In the embodiments of the present invention, however, a tank holder, to which the ink tanks 22 are attached, is further attached to a holder to which the recording head 21 is attached integrally therewith, so that these are mounted on the carriage 20 integrally. The recording head 21 and the ink tanks 22 execute recording using respective inks of black, cyan, magenta, and yellow. Further, the recording head 21 described in the embodiments is a so-called bubble jet recording head for forming bubbles in inks making use of thermal energy and ejecting the inks by the pressure of the bubbles. Accordingly, the recording head 21 is provided with an electrothermal transducer (not shown) for supplying thermal energy for generating bubbles used to eject the inks. Further, each recording head 21 has a liquid room for supplying an ink to nozzles communicating with the ejection ports, and the ink supplied from an ink tank 22 is accommodated in the liquid room once, and as the ink is ejected, the respective nozzles are refilled with the ink from the liquid room. In the present invention, the recording heads are provided in correspondence to the respective inks and the liquid room is provided for each ink.

Figure 2:
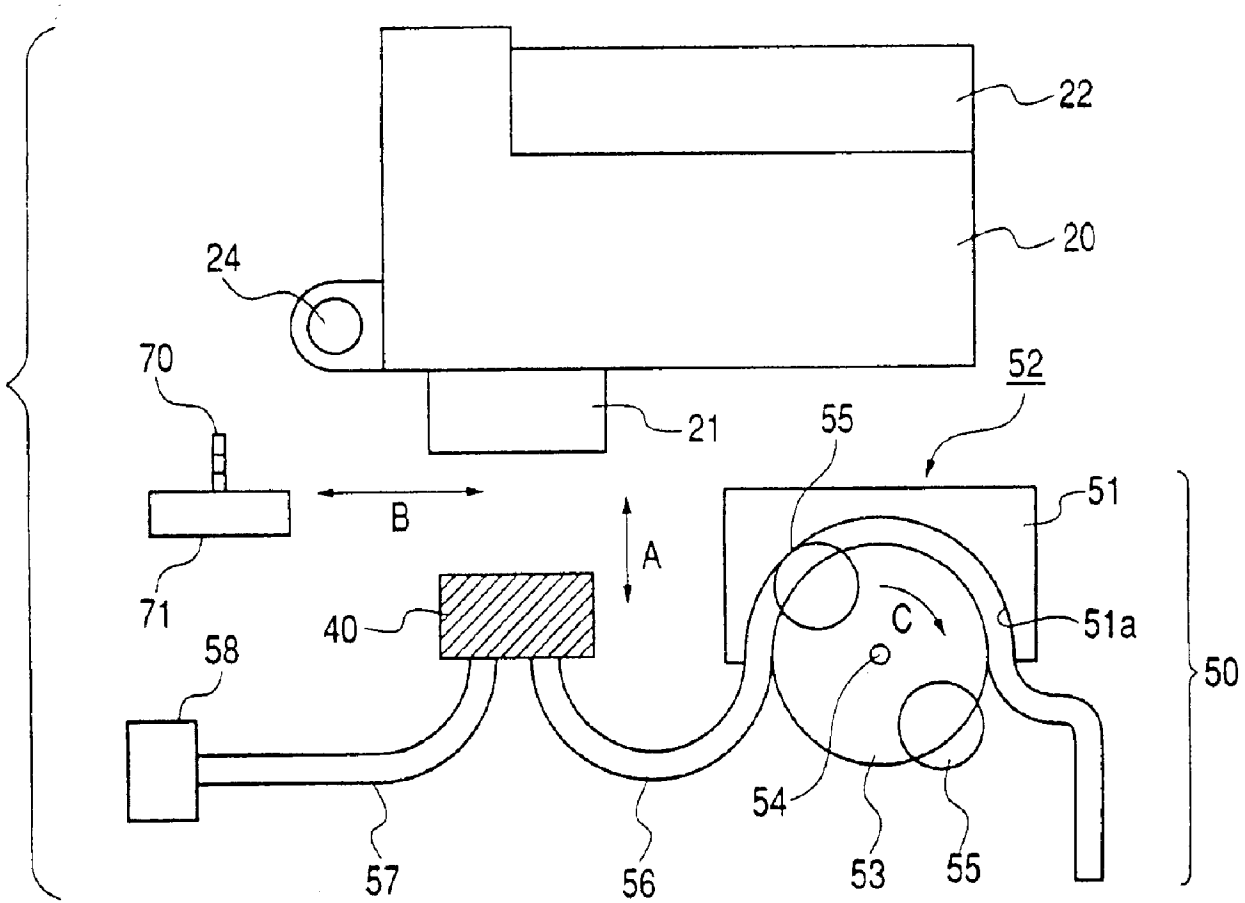
FIG. 2 is a schematic view showing an example of the arrangement of a recovery system disposed in the inkjet recording apparatus to which the present invention can be applied.

FIG. 2 is a schematic view showing the arrangement of the recovery system 50 of the inkjet recording apparatus shown in FIG. 1

In FIG. 2, reference numeral 24 denotes a shaft receiving portion of the carriage 20 through which the carriage 20 is engaged with the scanning rail 33. Further, reference numeral 40 denotes a cap capable of covering the ejecting port surface of the recording head 21. The cap 40 can be moved by an unshown mechanism (upward/downward moving mechanism) along the direction of an arrow A. When the carriage 20 is positioned above the recovery system disposed at a home position, the cap 40 moves upward and comes into intimate contact with the ejecting port surface and is separated therefrom by moving downward.

Further, in FIG. 2, reference numeral 56 denotes a suction tube for communicating with the cap, 57 denotes an atmosphere communication tube for communicating with the cap, and 58 denotes an atmosphere communication valve coupled with the atmosphere communication tube 57. The atmosphere communication valve can be opened and closed by an unshown cam mechanism. Reference numeral 52 denotes a suction pump arranged as a tube pump. Reference numeral 51 denotes a pump base having a tube guide surface 51*a* formed on the inside thereof in a semi-circular shape. Reference numeral 53 denotes a roller holder having two rollers 55 for generating negative pressure in the cap 40 in such a manner that the two rollers 55 rotate along the tube guide surface 51*a* of the pump base 55 about a rotating shaft 54 while squeezing the suction tube 56. Reference numeral 70 denotes a blade, and 71 denotes a blade holder for holding the blade 70. When the cap 40 moves downward and waits, the blade 70 of the blade holder 71 slides on the ejecting port surface 21*a* of the recording head 21 in the direction of an arrow B to thereby wipe debris such as dust, ink droplets, paper powder, and the like, remaining on the ejecting port surface 21*a* in abutment with the ejecting port surface 21*a*.

Figure 3:
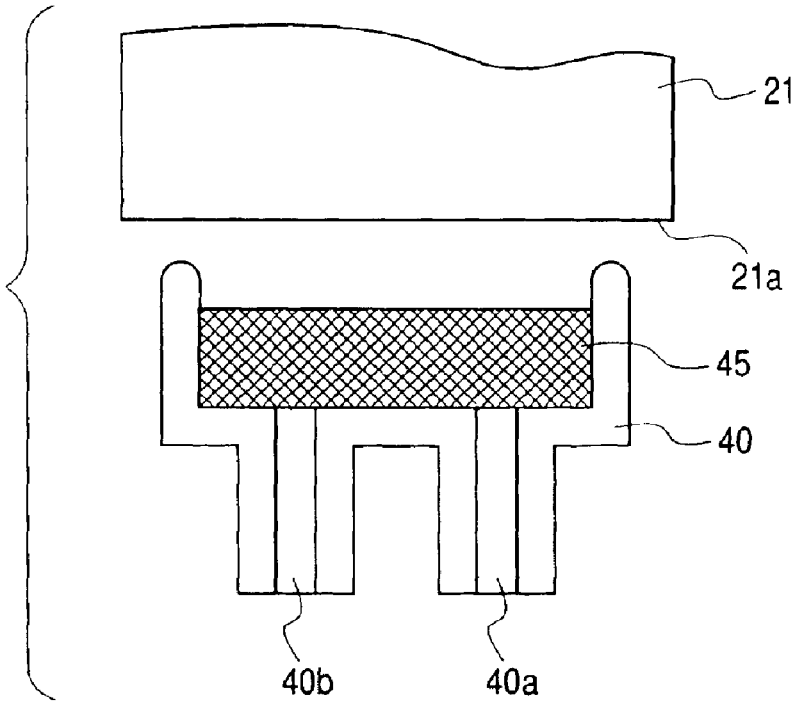
FIG. 3 is an enlarged sectional view of a cap portion.

FIG. 3 is an enlarged sectional view of a cap portion for explaining the arrangement of the cap 40. The cap 40 has a suction communication port 40*a* coupled with the suction tube 56 shown in FIG. 2. Reference numeral 40*b* denotes an atmosphere communicating port coupled with the atmosphere communication tube 57 shown in FIG. 2. Further, a porous absorbing member 45 is disposed in the cap 40.

Figure 4:
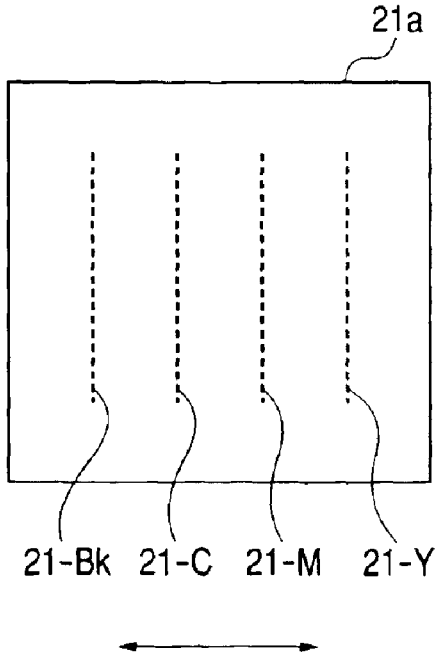
FIG. 4 is a view explaining an ejecting port surface of a recording head.

FIG. 4 is a view explaining the portion of the ejecting port surface of the inkjet recording head used in the embodiments. FIG. 4 shows a view of the recording head viewed from an ejection portion side. Further, an arrow shown in FIG. 4 shows the scanning direction (main scanning direction) of the carriage 20, and 21-Bk, 21-C, 21-M, and 21-Y denote nozzle trains of black, cyan, magenta, and yellow. As shown in the figure, a plurality of nozzles are disposed for each color along a direction different from the main scanning direction, and nozzle trains are formed of the plurality of nozzles and disposed along the main scanning direction.

In the embodiments of the present invention, the cap 40 is caused to come into intimate contact with the ejecting port surface 21*a* so as to cover all the nozzle trains corresponding to these four colors. Note that, in the present invention, the arrangement of the nozzles of the recording head 21 is not particularly limited to that shown in FIG. 4. An arrangement in which a nozzle train corresponding to the plurality of colors is disposed on a straight line, and an arrangement in which the order of the nozzle trains of the respective colors is changed from that shown in FIG. 4, may be employed.

Figure 5:
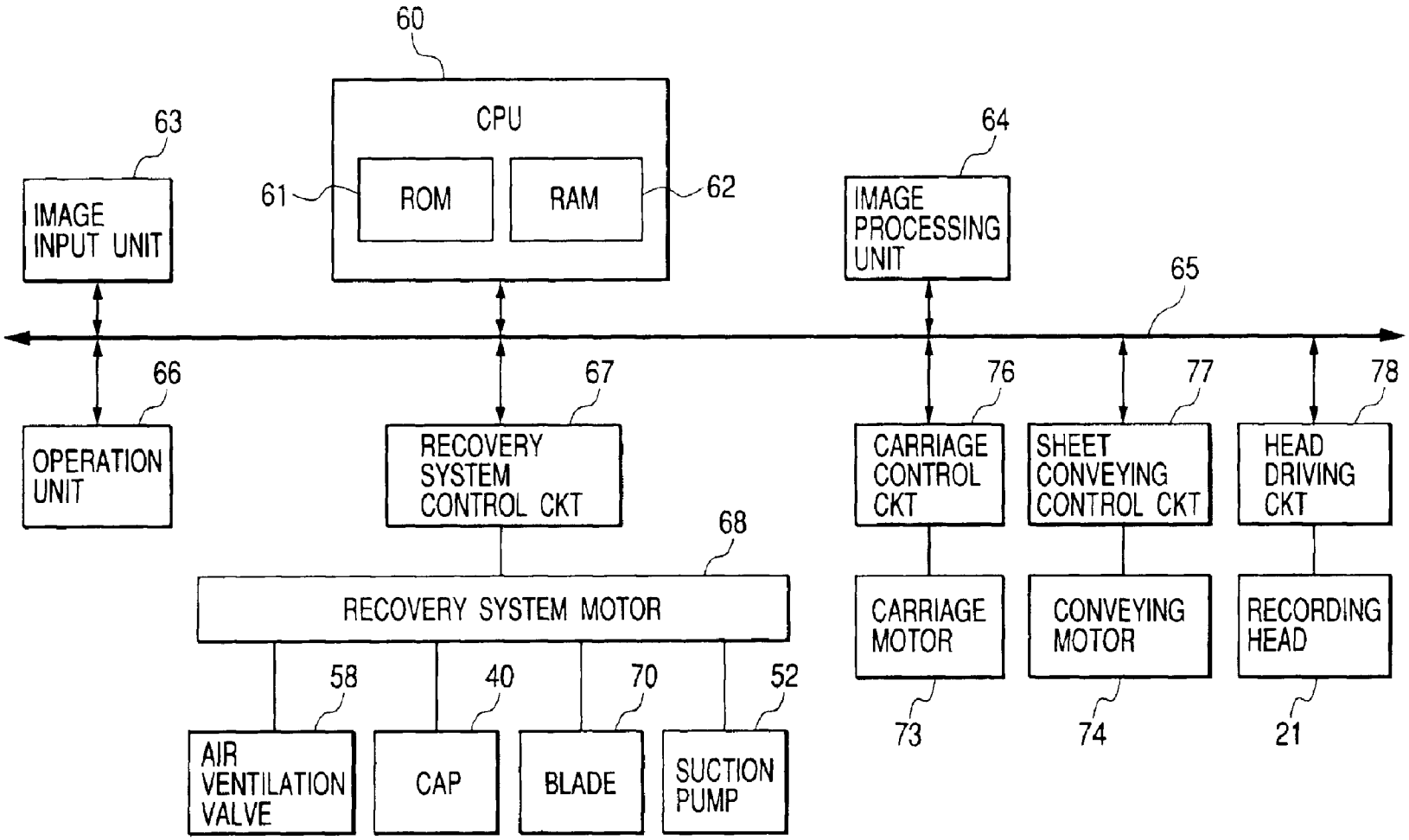
FIG. 5 is a block diagram showing an example of the arrangement of the inkjet recording apparatus to which the present invention can be applied.

FIG. 5 is a block diagram showing an example of the arrangement of the inkjet recording apparatus to which the present invention can be applied.

In the figure, the arrangement of the inkjet recording apparatus is broadly classified into a software system processing means and a hardware system processing means. The software system processing means includes an image input unit 63, an image signal processing unit 64 corresponding to the image input unit 63, a central processing unit (CPU) 60, and the like, the hardware system processing means includes an operation unit 66, a recovery system control circuit 67, a carriage control circuit 76, a sheet conveying control circuit 77, a head driving control circuit 78, and the like, and the respective units can access a main bus line 65.

The central processing unit 60 includes a program ROM 61 for storing a control program and a random access memory (RAM) 62 for storing various data such as print data to be supplied to the recording head 20. The central processing unit 60 supplies proper recording conditions to the carriage control circuit 76, the sheet conveying control circuit 77, and the head driving control circuit 78 in response to input information and executes recording by driving a carriage motor 73, a conveying motor 74, and the recording head 21. The ROM 61 also stores a program for executing a recovery operation timing chart (to be described later) and executes a recovery operation by supplying control conditions to the recovery system control circuit 67 and the head driving control circuit 78 when necessary (for example, in response to a command for executing a suction recovery operation supplied from the operation unit 66). The recovery system control circuit 67 drives a recovery system motor 68, and operates the cap 40, the atmosphere communication valve 58, the blade 70, and the suction pump 52 through an unshown cam mechanism, and the like, and the head driving control circuit 78, which drives the electrothermal transducers of the recording head 21, ejects inks in recording as well as preliminarily ejects inks. With the above arrangement, the recovery operation described below can be executed.

In the embodiments of the present invention, the pump is stopped temporarily, and then the atmosphere communicating valve is opened in a state in which the ejecting port surface is covered with the cap. However, the present invention is not limited thereto, and the atmosphere communicating valve may be opened while the pump executes a suction operation.

Further, the embodiments of the present invention have been described as to the arrangement in which one cap is employed for the convenience of description. However, the present invention is not limited to the above arrangement and can be applied to an arrangement in which a plurality of caps are provided and execute a suction operation, respectively. Further, the present invention can be also applied to an arrangement in which any of a plurality of caps executes the suction operation.

Further, although the pump necessary for the suction operation has been described as the tube pump as an example, the pump is not particularly limited to the tube pump, and any pump may be employed as long as it can generate negative pressure in the cap.

(First embodiment)

First, a first embodiment of the present invention having the characteristic arrangements of the invention will be described.

In the first embodiment, the inkjet recording apparatus arranged as shown in FIGS. 1 and 2 executes the following control operation.

At the start of printing, the recording head 21, which is covered with the cap 40 in the recovery system 50 disposed at the home position, is set to a cap open state by being separated from the cap 40, and the printing is started by starting a cap-open timer as soon as the cap 40 is opened. Then, the period during which the cap is opened is cumulated by the cap-open timer, and when the cumulated period exceeds a predetermined period Th, a recovery control such as suction is executed. When the recovery suction is executed, the cap-open timer is reset.

Figure 7:
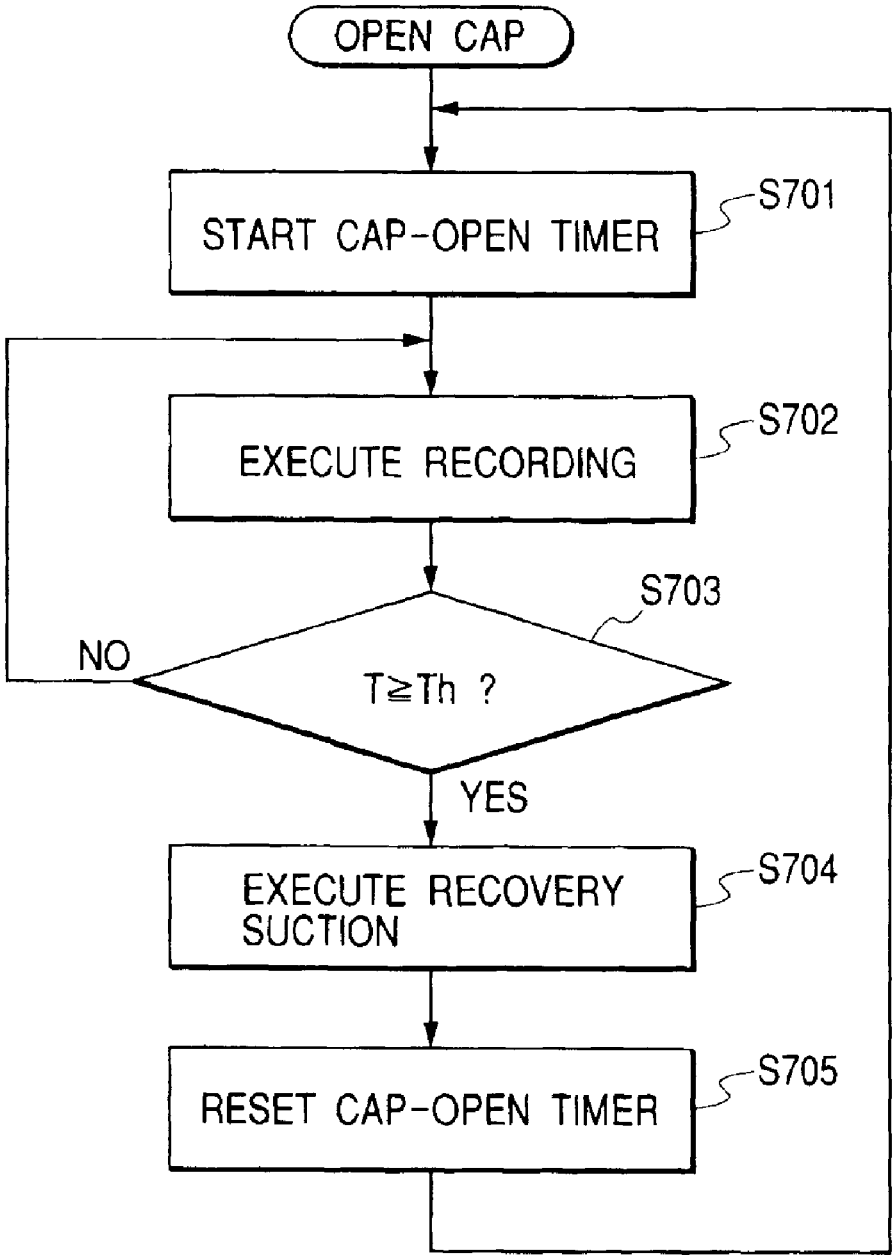
FIG. 7 is a flowchart showing a sequence when an ordinary recording operation is executed in a first embodiment of the present invention.

First, a cap-open timer suction control, which is executed when the cap is continuously opened, will be explained with reference to the flowchart of FIG. 7.

First, the cap is opened, and then the cap-open timer is turned on at step S701. At step S702, recording is started. At step S703, it is determined whether or not the elapsed period T of the cap-open timer is equal to or more than a predetermined threshold value Th. When T<Th, the process goes to step S702, whereas when T≧Th, the process goes to step S704 and suction recovery is executed. At step S705, the cap-open timer is reset (T=0), and the process returns to step S701.

Figure 6:
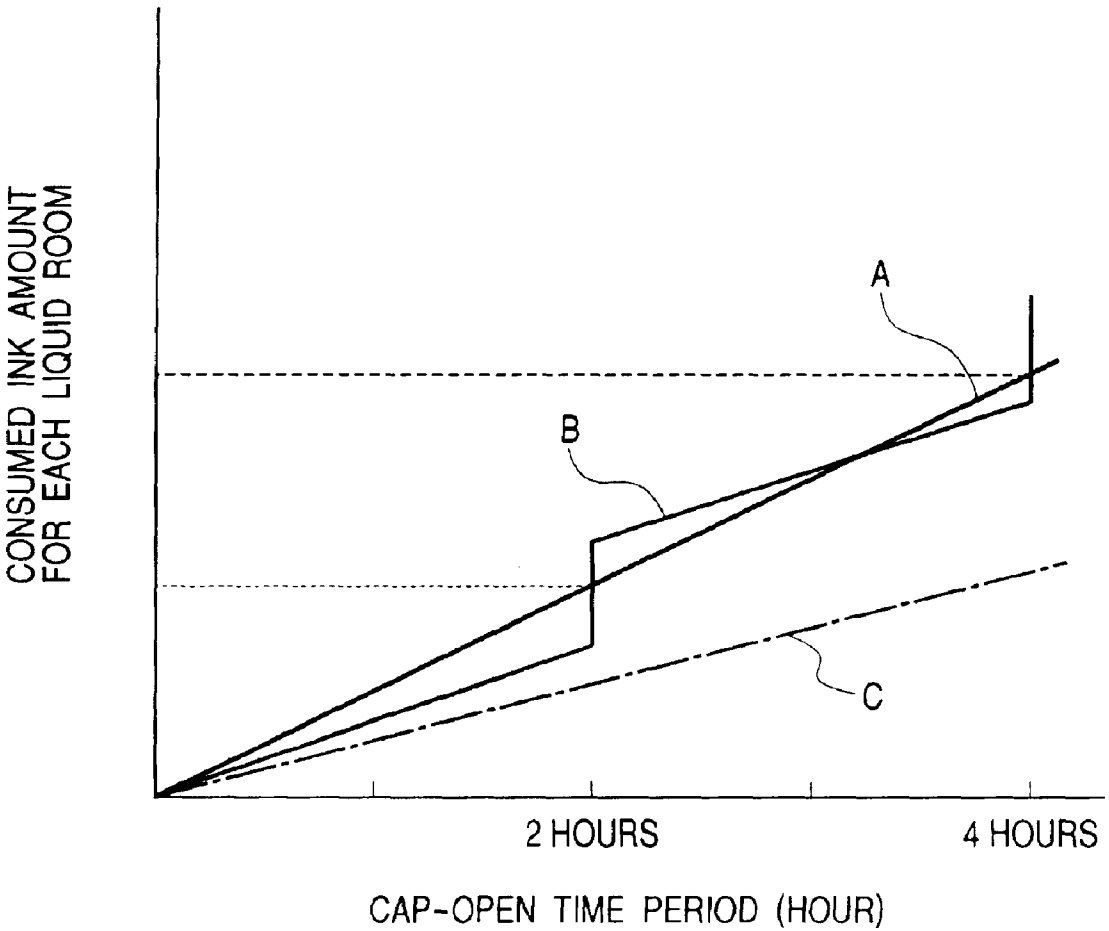
FIG. 6 is a graph showing the relationship between a consumed ink amount per one liquid room and a cap-open period in embodiments of the present invention.

The graph of FIG. 6 shows an example of the relationship between a cap-open period and a consumed ink amount for each liquid room for preventing adhesion of evaporated inks and crystallization of impurities in the ejecting ports. Note that the liquid rooms are disposed to the recording head as described above, and "the consumed ink amount for each liquid room" means an amount of each ink consumed.

A straight line A in FIG. 6 shows a relationship between a consumed ink amount for each liquid room and a cap-open period when defective ejection does not occur. That is, the straight line A shows that no defective ejection occurs when a consumed ink amount with respect to a period is larger than the amount shown by the straight line in a state in which the cap is opened.

A straight line C of FIG. 6 shows the relationship between a consumed ink amount for each liquid room and a cap-open period when only timer preliminary ejection is executed. That is, when the consumed ink amount is below the straight line C at the time the threshold value Th is exceeded in the state in which the cap is opened, clogging occurs by the precipitation of adhered inks and impurities in the vicinities of the nozzles. That is, clogging occurs when the consumed ink amount in a predetermined period is less than the amount of ink that must be consumed to prevent clogging. It has been found by experiment that when the cap-open period exceeds about two hours, adhesion of evaporated inks and crystallization of impurities begin. Accordingly, the predetermined threshold value Th is set to two hours, and when the cap-open period exceeds two hours, a predetermine amount of ink (about 0.13 g) is sucked for recovery. A straight line B in FIG. 6 shows the relationship between a consumed ink amount for each liquid room and a cap-open period at that time.

It is assumed that depending on a recording operation, only an ink of a particular color is consumed or an ink of a particular color is consumed more than inks of other colors. Accordingly, a straight line, which shows the consumed ink amount as to an ink of color which is consumed in small amount, has an inclination smaller than that of the straight line C of FIG. 6, although an ink, which is consumed in large amount, may be consumed in amount larger than that shown by the straight line A. Further, in an extreme example such as recording of a monochrome image, no color ink is consumed. Thus, according to the present invention, periods during which the cap is opened are cumulated, and the recovery operation is executed according to the cumulated period, thereby problems caused by the evaporation of inks can be avoided.

Further, when T≦Th, the cumulated cap-open period is stored in a memory as a storing means in the apparatus after the cap is closed, and when the cap is opened next time, the cumulated cap-open period stored is read out, and the cap-open timer starts to measure a cap-open period from the cumulated cap-open period. When any type of the suction recovery operation is executed here, the cap-open timer is reset. That is, when a user issues a command for executing forcible suction recovery processing or when the suction recovery processing is executed due to another factor, the cap-open timer is reset.

Further, in the embodiment described above, since the cap-open period is approximately equal to a print period, the print period may be used as the cap-open period.

With the above operation, when recording is executed using only certain particular nozzles, inks can be refreshed by executing the suction, thereby it is possible to prevent occurrence of printing defects caused by the adhesion of evaporated inks and crystallization of impurities in the vicinities of unused nozzles.

(Second Embodiment)

Next, a second embodiment of the present invention will be explained in detail.

In the second embodiment, a recovery operation is controlled by calculating a consumed ink amount in order to reduce ink consumption by further reducing the number of times of suction processing executed when a cap-open timer operates as in the first embodiment. Note that the consumed ink amount is calculated by a dot counting method. The dot counting method is a method of counting the number of dots formed by inks droplets ejected in recording, and the consumed ink amount can be estimated by counting data based on which inks are ejected. Note that although each ink droplet can be used as a unit of count in the dot count, a predetermined number of dots may be used as the unit of count. In the second embodiment, when a consumed ink amount exceeds a suction amount in cap-open timer suction, both the cap-open timer and a dot counter are reset so that no suction recovery processing is executed.

Figure 8:
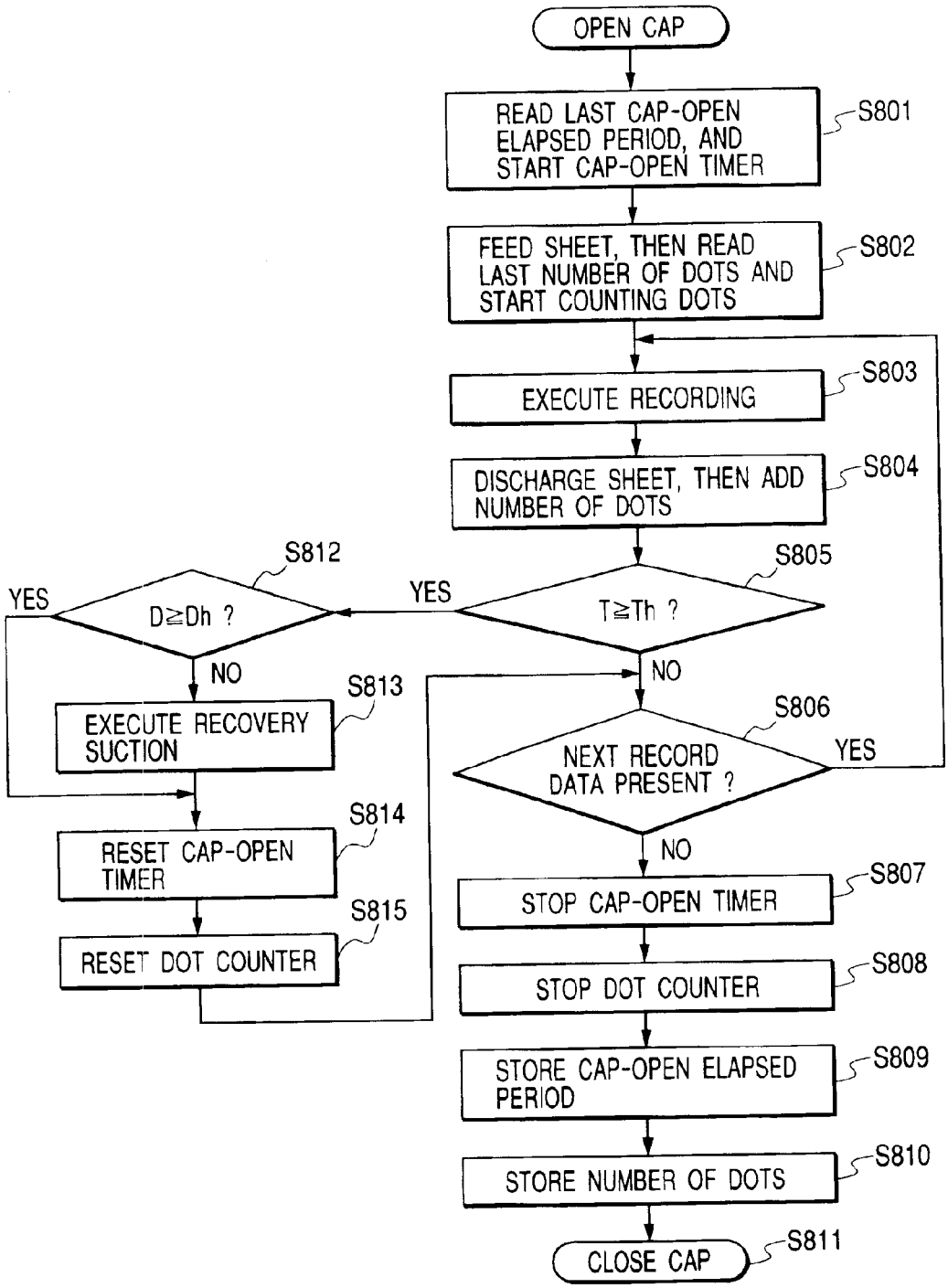
FIG. 8 is a flowchart showing a sequence when a recording rate is set in a second embodiment of the present invention.

The timer suction control of the second embodiment, which is executed based on the number of dots when the cap is opened, will be explained with reference to the flowchart of FIG. 8.

First, at step S801, after the cap is opened, a previous cap-open elapsed period is read, and the cap-open timer is operated. At step S802, the previous number of dots is read, and dot counting is started. At step S803, a recording operation is executed. After a sheet is discharged at step S804, the number of dots in the recording operation is read and added to the previous number of dots. At step S805, it is determined whether or not the cap-open elapsed period T is equal to or more than the predetermined threshold value Th. When T≧Th, the process goes to step S812 and determines whether or not the number of dots D is equal to or larger than a predetermined number of dots Dh. When D≧Dh, the process goes to step S814, whereas when D<Dh, the process goes to step S813, executes the recovery suction and then goes to step S814. At step S814, the cap-open timer is reset. At step S815, the dot counter is also reset, and the process goes to step S806. Further, when T<Th at step S805, the process goes to step S806 and determines whether or not next recorded data is present. When the process determines that the next recorded data is present, it returns to step S803, whereas when the process determines that no next recorded data is present, it goes to step S807 and stops the cap-open timer. Next, at step S808, the dot counter is stopped. At step S809, a cap-open elapsed period is stored, and, at step S810, the number of ejected dots is stored. Next, at step S811, the cap is closed.

Further, in order to further reduce the ink amount consumed by the suction recovery, when the predetermined period Th has elapsed and the number of dots D has not yet exceeded the predetermined number of dots Dh, the amount of ink to be sucked in the recovery suction is set to the amount obtained by subtracting the number of dots D from the predetermined number of dots Dh (Dh−D), and the suction recovery operation may be controlled according to the set suction amount.

With the above arrangement, since the suction recovery operation need not be executed more frequently than necessary while executing the operation the necessary number of times, the consumed ink amount can be suppressed as well as the reliability of the apparatus can be improved while maintaining a printed state of high quality.

(Third Embodiment)

Next, a third embodiment of the present invention will be explained.

The third embodiment is provided with, for example, a plurality of caps and a recovery means capable of independently executing the suction recovery processing in each of the caps in the arrangement explained in the first and second embodiments. In the arrangement of the third embodiment, the discharged amount of ejected inks is measured as to each cap and the discharged amount (discharged number of dots) of each type of inks is calculated. When the consumed amounts of respective inks (consumed ink amount of C, M, Y) exceed a predetermined amount, respectively, both the cap-open timer and the dot counter are reset, and when any of them does not satisfy the above conditions, the suction recovery operation is executed.

Figure 9:
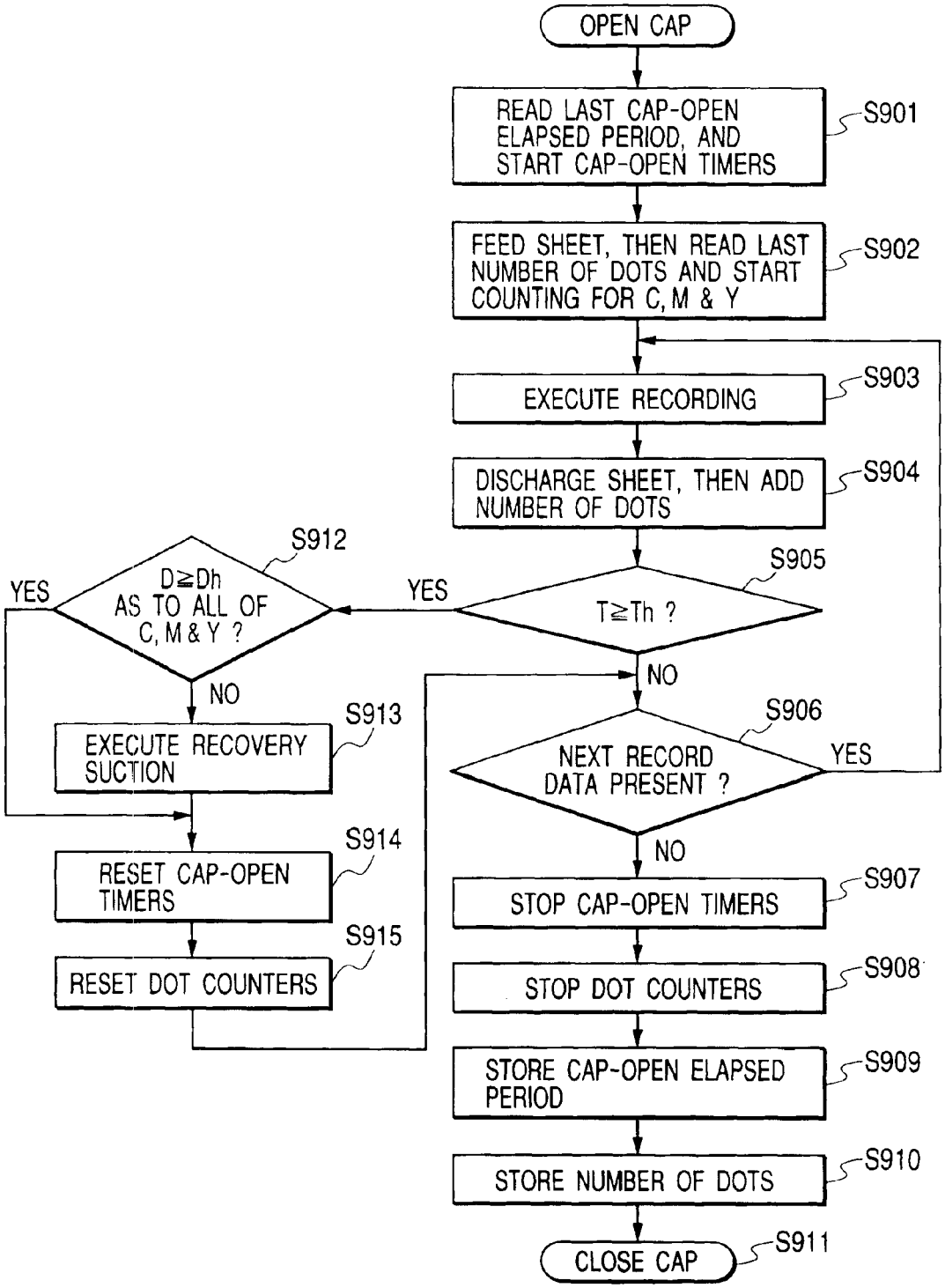
FIG. 9 is a flowchart showing a sequence when a both surface recording operation is executed in a third embodiment of the present invention.

Next, a case, in which it is determined whether or not a timer suction recovery operation is executed based on, for example, the counted value of the respective inks (C, M, Y) in the third embodiment, will be explained with reference to the step S905 and the steps S912 to S915 shown in the flowchart of FIG. 9. The steps other than above steps are not explained here because they are the same as those in the flowchart of the second embodiment.

First, at step S905, it is determined whether or not the cap-open elapsed period T is equal to or more than the predetermined threshold value Th. When T≧Th, the process goes to step S912, and when all the numbers of dots of C, M, Y are larger than the predetermined number of dots Dh, the process goes to step S914, whereas when any one of the numbers of dots is less than the predetermined number of dots Dh, the process goes to step S913. At step S913, the recovery suction is executed and inks are refreshed, and the process goes to next step S914. At step S914, the cap-open timer is reset. Next, at step S915, the dot counter is reset, and the process goes to step S906 to continuously execute the sequence.

With the above operation, even if a particular cap or ink is used less frequently, occurrence of printing defects in the vicinities of the nozzles due to adhesion of evaporated inks and crystallization of impurities can be prevented.

As described above, according to the present invention, the period during which the cap (caps) for capping the ejection ports of the recording head opens (open) is managed and the recovery suction is executed when the cap-open state continues for a predetermined period. As a result, occurrence of a phenomenon, in which inks begin to evaporate in the vicinities of the nozzles of unused nozzle trains while inks are continuously ejected from a particular nozzle train and the nozzles of the unused nozzle trains are clogged by adhesion of the evaporated inks and crystallization of impurities, can be minimized, and thereby printing of high quality can be maintained.

Further, the number of times of the recovery suction can be reduced by preventing the recovery suction from being executed unnecessarily by managing the number of dots of each cap and each ink, thereby recording of high quality can be maintained while suppressing a consumed amount of inks.

What is claimed is:

1. An inkjet recording apparatus for executing recording by ejecting ink onto a recording medium based on recording data using a recording head for ejecting the ink from ejection ports, comprising:

recovery means for executing recovery processing for maintaining the ink ejection capability of the recording head;

a cap member for capping the ejection ports of the recording head;

capping means for moving said cap member in a direction in which said cap member approaches the recording head and in a direction in which said cap member is separated from the recording head;

measurement means for measuring a cap-open period that is an elapsed period of a cap-open state while recording onto the recording medium, in which the ejection ports are not capped with said cap member;

control means for executing the recovery processing by said recovery means when the can-open period cumulated by cumulation means exceeds a predetermined period; and calculation means for calculating the amount of ink discharged from the recording head by ejection, wherein said control means resets the cumulated period when the recovery processing is executed while the cap-open period is cumulated, and wherein when the cumulated period is longer than the predetermined period, said control means further determines whether or not the discharged amount of the ink calculated by said calculation means is greater than a predetermined amount, and when the discharged amount of the ink is greater than the predetermined amount, the recovery processing is further executed by said recovery means.

2. An inkjet recording apparatus according to claim 1, wherein said measurement means uses the elapsed period during which the recording is executed on the recording medium as the cap-open period.

3. An inkjet recording apparatus according to claim 1, wherein said capping means can move said cap member to a capping state in which the ejection ports are capped with said cap member and to the cap-open state.

4. An inkjet recording apparatus according to claim 1, wherein the recovery processing executed by said recovery means includes suction recovery processing for discharging the ink from the ejection ports by suction.

5. An inkjet recording apparatus according to claim 1, wherein when the discharged amount of the ink is greater than the predetermined amount, said control means resets the cumulated period and the calculated discharged amount of the ink.

6. An inkjet recording apparatus according to claim 1, wherein said calculation means calculates the discharged amount of the ink by counting the number of ink droplets ejected from the recording head.

7. An inkjet recording apparatus according to claim 1, further comprising:

determination means for determining whether or not the recording data to be recorded next is present; and memory means for storing the cumulated period and the discharged amount of the ink, wherein when determined that the recording data to be recorded next is not present, said control means controls said capping means such that the ejection ports are capped with said cap member and stores the cumulated period and the discharged amount of the ink in said memory means.

8. An inkjet recording apparatus according to claim 7, wherein said recovery means executes the recovery processing by discharging the ink by suction, and the recovery processing is executed differently by changing the amount of ink to be sucked.

9. An inkjet recording apparatus according to claim 1, wherein a plurality of the cap members are provided, and the cap-open period is measured and cumulated by said measurement means for each cap member.

10. An inkjet recording apparatus according to claim 1, wherein a plurality of recording heads are used in correspondence to colors of the inks to be recorded, and the cap-open period is measured and cumulated for each of the ink colors.

* * * * *